US010639508B2

(12) United States Patent
Müller et al.

(10) Patent No.: US 10,639,508 B2
(45) Date of Patent: May 5, 2020

(54) METHOD AND SYSTEM FOR PREVENTING AND/OR EXTINGUISHING A FIRE

(71) Applicant: AMRONA AG, Zug (CH)

(72) Inventors: Markus Müller, Mannedorf (CH); Peter Stahl, Zürich (CH)

(73) Assignee: AMRONA AG, Zug (CH)

( * ) Notice: Subject to any disclaimer, the term of this patent is extended or adjusted under 35 U.S.C. 154(b) by 268 days.

(21) Appl. No.: 15/539,297

(22) PCT Filed: Oct. 21, 2015

(86) PCT No.: PCT/EP2015/074316
§ 371 (c)(1),
(2) Date: Jun. 23, 2017

(87) PCT Pub. No.: WO2016/110340
PCT Pub. Date: Jul. 14, 2016

(65) Prior Publication Data

US 2017/0368390 A1 Dec. 28, 2017

(30) Foreign Application Priority Data

Jan. 9, 2015 (EP) ..... 15150664

(51) Int. Cl.
*A62C 3/07* (2006.01)
*A62C 99/00* (2010.01)

(52) U.S. Cl.
CPC ..... *A62C 3/07* (2013.01); *A62C 99/0018* (2013.01)

(58) Field of Classification Search
CPC .... A62C 3/07; A62C 3/08; A62C 3/10; A62C 99/0018; B01D 2257/102; B01D 2256/10
USPC ..... 169/11, 62
See application file for complete search history.

(56) References Cited

U.S. PATENT DOCUMENTS 3,715,438 A 2/1973 Huggett
3,893,514 A 7/1975 Carhart et al.
4,121,790 A 10/1978 Graham
(Continued)

FOREIGN PATENT DOCUMENTS

CN 101242877 A 8/2008
CN 101843963 A 9/2010
(Continued)

*Primary Examiner* — Cody J Lieuwen
(74) *Attorney, Agent, or Firm* — Shumaker, Loop & Kendrick, LLP; James D. Miller

(57) ABSTRACT

A system for preventing and/or extinguishing a fire in an enclosed target area in a vehicle. The system having a central compressed air source for supplying compressed air to a load circuit. A supply of compressed air is provided in a compressed air buffer tank is supplied to a gas separation device from the compressed air buffer tank. A nitrogen-enriched gas mixture is provided at an outlet of the gas separation device, and introduced into the target area. An inlet of the compressed air buffer tank is at least temporarily fluidically connected to an outlet of a central compressed air source, wherein compressed air can be supplied to the compressed air buffer tank. A fluidic connection is provided between the central compressed air source and the compressed air buffer tank if a load circuit is not drawing any compressed air from the central compressed air source.

7 Claims, 1 Drawing Sheet

(56) References Cited

U.S. PATENT DOCUMENTS

| | | | | |
|---|---|---|---|---|
| 4,378,920 | A * | 4/1983 | Runnels | B64D 37/32 137/209 |
| 5,799,652 | A | 9/1998 | Kotliar | |
| 5,887,439 | A | 3/1999 | Kotliar | |
| 2005/0247197 | A1* | 11/2005 | Snow, Jr. | A62C 3/06 95/138 |
| 2006/0213673 | A1 | 9/2006 | Kotliar | |
| 2008/0168798 | A1* | 7/2008 | Kotliar | A62C 3/0221 62/640 |
| 2008/0223955 | A1* | 9/2008 | Sprakel | A62C 3/07 239/253 |
| 2010/0236796 | A1* | 9/2010 | Chattaway | A62C 37/44 169/46 |
| 2011/0206538 | A1* | 8/2011 | Yokota | F04B 41/02 417/1 |
| 2012/0267126 | A1* | 10/2012 | Volk | A62C 3/07 169/46 |
| 2014/0345885 | A1* | 11/2014 | Wagner | A62C 99/0018 169/46 |

FOREIGN PATENT DOCUMENTS

| | | | |
|---|---|---|---|
| CN | 101968244 | A | 2/2011 |
| DE | 102008047663 | A1 | 4/2010 |
| EP | 0234056 | A1 | 9/1987 |
| EP | 0301464 | A2 | 2/1989 |
| EP | 0374333 | A1 | 6/1990 |
| FR | 2748396 | A1 | 11/1997 |
| RU | 2525801 | C1 | 8/2014 |
| WO | 9637176 | A1 | 11/1996 |
| WO | 9834683 | A1 | 8/1998 |
| WO | 9947210 | A1 | 9/1999 |
| WO | 0178843 | A3 | 10/2001 |

* cited by examiner

METHOD AND SYSTEM FOR PREVENTING AND/OR EXTINGUISHING A FIRE

CROSS-REFERENCE TO RELATED PATENT APPLICATIONS

This patent application is a United States national phase patent application based on PCT/EP2015/074316 filed Oct. 21, 2015, which claims the benefit of European Patent Application No. 15150664.9 filed Jan. 9, 2015, the disclosures of which are hereby incorporated herein by reference in their entirety.

FIELD OF THE INVENTION

The present invention relates to a method and a system for preventing and/or extinguishing a fire in an enclosed target area of a vehicle, in particular in a track-guided vehicle.

BACKGROUND OF THE INVENTION

The system engineering of fire protection in vehicles, in particular track-guided vehicles such as railway vehicles, is of increasing importance, as is also borne out for example by the ratification of numerous national and international standards and directives in recent years. For example, the TSI (Technical Specification for Interoperability), the EN45545 and the EN50553 define measures outlining the extent to which rail vehicles are to be equipped with active fire protection systems. These new provisions serve personnel safety, increasing safety in tunnels and ultimately also protecting railway vehicle property. Accordingly, there is an increased need for effective fire protection systems for railway vehicles or similar track-guided vehicles.

However, the complexity of track-guided vehicles, in particular railway vehicles, usually requires an individual fire protection concept which is not so readily comparable to the solutions known in structural fire protection since there are clearly different risks in railway vehicles.

In addition to the early detection of fire with aspirative smoke detectors and automatic smoke detectors, automatic fire suppression in particular also plays a substantial role. Typical areas of operation thereto are electrical equipment, control cabinets, roof and underfloor fittings, sleeper or couchette cars, passenger compartments, drive assemblies and other areas of increased fire risk.

Inert gas extinguishing technology is particularly recommended for protecting against fire in sectioned areas such control and electrical cabinets since the necessary extinguishing concentration is able to be readily maintained in such sectioned areas.

In inert gas extinguishing technology, the protected area (sectioned area) is at least partially flooded with an oxygen-displacing gas such as, for example, nitrogen, argon or $CO_2$ (hereinafter also referred to as "inert gas") and thus rendered inert.

The preventative or extinguishing effect resulting from rendering a protected area inert is based on the principle of oxygen displacement. As is known, normal ambient air consists of about 21% oxygen by volume, about 78% nitrogen by volume and about 1% by volume of other gases. In order to effectively lower the risk of a fire breaking out in a given protected area, such as for example in an enclosed room, the oxygen content within the relevant area is decreased by introducing inert gas or an inert gas mixture respectively such as e.g. nitrogen. As regards extinguishing fire in the case of most solid matter, an extinguishing effect is for example known to begin when the percentage of oxygen drops below about 15% by volume. Depending upon the flammable substances situated in the protected area, it may be necessary to further lower the percentage of oxygen to, for example, 12% by volume.

Particularly when used in track-guided vehicles, preventive inertization of the relevant target areas is advantageous upon start-up. Due to a respective vehicle's mobility and minimum available space, there are also only few possibilities for implementing effectual fire prevention and extinguishing system. Furthermore, such a system must not substantially impact either the vehicle's normal operation nor its safety-relevant functions.

Existing systems for preventing and/or extinguishing fires within vehicles and/or aircraft provide in particular for supplying nitrogen-enriched gas mixtures in storage tanks and/or by means of additional generators. Thus, to be able to ensure sufficient inertization of enclosed rooms, conventional fire prevention and extinguishing systems require a great deal of space within the respective vehicle or can only be used for rooms of small spatial volumes. Therefore, a larger installation space in terms of volume is needed to accommodate the components of an in-vehicle fire prevention and extinguishing system. Moreover, such prior art gas or water droplet extinguishing systems are only activated once a fire has already developed and the associated components in the respective area of the vehicle have already suffered damage.

An alternative is the system known from DE 10 2008 047 663 which provides a controlled nitrogen atmosphere for transporting large amounts of fruits using a ship's existing on-board compressed air system. This system can however also be used to produce nitrogen for tanker loading tanks to prevent risks of fire and explosion.

SUMMARY OF THE INVENTION

The invention is based on the task of providing a customized fire protection concept particularly for track-guided vehicles such as railway vehicles so as to meet the respective requirements relative to personnel safety and/or vehicle property protection. In particular to be specified is an efficient and easily realized method for preventing and/or extinguishing a fire in a vehicle, particularly a track-guided vehicle, as well as a corresponding system. Accordingly, the fire prevention and/or extinguishing system must thereby in particular be able to be integrated into the track vehicle's existing infrastructure and represent a cost-efficient as well as space-saving solution. There must likewise be sufficient system inertization capacity so as to be able to render a target area inert on short notice and maintain it during the vehicle's operation.

The task of which the invention is based is solved by a method and a system as shown and described herein. The present invention moreover discloses a corresponding vehicle for accommodating a system as shown and described herein.

Thus, the claimed method can be used to prevent and/or extinguish a fire in an enclosed target area of a track-guided vehicle. To this end, the track-guided vehicle comprises a central source of compressed air which serves in providing a supply of compressed air in a compressed air buffer tank. Compressed air can be supplied from the compressed air buffer tank to a gas separation device as needed, whereby a nitrogen-enriched gas mixture is provided at the outlet of the gas separation device as a result of the gas separation. This can thereafter be introduced into the target area as needed with the objective of achieving a desired inertization level in the target area of the track-guided vehicle. In conjunction hereto, the present invention is in particular characterized by there only being intermittent fluid communication between the outlet of the central compressed air source and the compressed air buffer tank for the supplying of compressed air.

To be understood by a track-guided vehicle in connection with the present invention is in particular a railway vehicle such as, for example, streetcars, freight or passenger trains. It can equally be assumed in the context of the present invention that the claimed invention is applicable to any type of track-guided vehicle including also magnetic levitation trains and other such comparable vehicles which depend on the guidance of a given track.

Furthermore, the as-needed introducing of compressed air into the compressed air buffer tank and/or the as-needed introducing of a nitrogen-enriched gas mixture into the target area characterizes a procedure which can be implemented both manually by at least one user and/or automatically by a control unit and/or a control device. This thus achieves the advantage of reaching a necessary level of inertization in the target area and being able to maintain it over a desired period of time. This can in particular be understood as a possible implementation of the invention ensuing based on fully automatic control as well as on semiautomatic control with corresponding user input.

A gas separation device provides a nitrogen-enriched gas mixture which, in the context of the present invention, is introduced as inert gas. The gas separation device can hereby be for example a membrane nitrogen generator, a Pressure Swing Adsorption (PSA) or Vacuum Pressure Swing Adsorption (VPSA) system, or another module known from the prior art for producing an appropriate inert gas. In particular, the described nitrogen-enriched gas mixture is to be used as inert gas for rending the target area inert since doing so results in the advantage of being able to continuously provide the inert gas necessary for inertization based on the ambient air. Moreover, reference is to a gas mixture since pure inert gas such as e.g. a noble gas is not provided from the ambient air, provided is rather simply a gas mixture having an increased proportion of nitrogen. Thus, further ambient air components such as low proportions of oxygen can potentially also still be present in the provided nitrogen-enriched gas mixture.

Compressed air is supplied to the compressed air buffer tank pursuant to the present invention via an intermittent fluid connection between the central compressed air source of the track-guided vehicle and the compressed air buffer tank. In particular, such a fluid connection exists when no compressed air is being extracted from the central compressed air source by a load circuit of the vehicle.

In accordance with one embodiment of the inventive method, an initial lowering of the oxygen concentration in the target area commences prior to and/or subsequent vehicle activation. The initial lowering concludes prior to and/or subsequent the track vehicle's start of travel. Preferably, the initial lowering concludes prior to the vehicle traveling for example through a tunnel or other such comparable track routes. The inertization terminates once travel ceases so that a normal atmosphere is reached in the target area and personnel can for example perform maintenance work in the target area.

To implement the initial lowering, the oxygen concentration in the target area is determined and compared to a preferably preset control concentration or control range respectively. As a result, compressed air is supplied as needed to the gas separation device and a nitrogen-enriched gas mixture for introducing into the target area as needed is provided at the outlet of the gas separation device, wherein the as-needed introducing terminates upon the target area reaching the control concentration or control range. If the oxygen concentration in the target area subsequently fluctuates, for example due to leakages and/or leaks in the target area, a replenishing of the nitrogen-enriched gas mixture ensues pursuant to the invention so that the preferably preset control concentration and/or control range can be continuously maintained.

As defined by the invention, an oxygen concentration control concentration or control range respectively specifies a preferably predefined value at which fire can be prevented and/or extinguished in the target area by way of a reduced concentration of oxygen. Both a control concentration as well as a control range can be preset as a regulating limitation in order to obtain an adequate and efficient control response for the as-needed introduction of the nitrogen-enriched gas mixture.

A control range comprises at least one upper or at least one lower limit, preferably one upper and one lower limit, for regulating the oxygen concentration in the target area. A control concentration, however, corresponds to a preferably preset specific concentration value. These control range/control concentration definitions are to apply to all regulating procedures in the context of the invention.

In a further embodiment, the inventive method comprises at least one fire characteristic being detected by a fire detection device. Said fire detection device is preferably an aspirative fire detection device. As a result of a fire characteristic being detected and a predefined threshold for the detected fire characteristic being exceeded, a full inerting of the target area can be implemented which corresponds to a preferably preset oxygen concentration and/or oxygen concentration range. In the context of the present invention, a full inerting of the target area's ambient air corresponds to the oxygen concentration limit values known from the prior art. Aspirative fire detection, as used in accordance with the present invention, enables achieving the advantage of sensitive detection of the at least one fire characteristic for the entire spatial volume of the target area by sampling representative air samples.

The term "fire characteristic" as used herein is to be understood as physical variables subject to measurable changes in the vicinity of fire, for example the ambient temperature or the proportion of solids, liquids or gas in the ambient air such as e.g. smoke particles, smoke aerosols, vapor or fumes.

According to the inventive method, one load circuit is designed as a main load circuit, whereby an auxiliary load circuit is preferably further provided. In this context, there is in particular also fluid communication between the central compressed air source and compressed air buffer tank when a compressed air load of the auxiliary load circuit extracts or respectively consumes compressed air from the central compressed air source. The dividing of the track-guided vehicle's load circuit into a main load circuit and an auxiliary load circuit ensues on the basis of its safety-related relevance.

A main load circuit preferably includes a track vehicle's safety-relevant compressed air loads. In the context of the present invention, this particularly refers to compressed air loads of the brake mechanisms, air suspension systems, compartment and exterior doors and further safety-relevant components of a track-guided vehicle.

An auxiliary load circuit includes all of a track vehicle's remaining compressed air loads of lower priority. This preferably refers to compressed air loads of the sanitary systems and further loads not having safety-related relevance for the vehicle operation. In addition, it is also conceivable for a plurality of auxiliary load circuits to be provided within the load circuit which have different priorities between them for being supplied with compressed air.

In terms of the claimed invention, there is no fluid communication between the central compressed air source and the compressed air buffer tank when a load in the main load circuit extracts or consumes compressed air from the central compressed air source. This in particular achieves the advantage of always being able to supply compressed air from the central compressed air source to the safety-relevant loads of the main load circuit at all times. The inventive method thus does not impact vehicle safety despite intermittently drawing from the central compressed air source. It is thereby always possible to supply compressed air from the central compressed air source for the safety-related compressed air loads in the main load circuit at all times.

Fluid communication preferably exists between the central compressed air source and compressed air buffer tank in the case of no compressed air being drawn from the central compressed air source or a load in the auxiliary load circuit of lesser safety-related relevance consuming compressed air. Supplying the fire prevention and/or fire extinguishing system with compressed air thus at no time affects vehicle safety and/or the track vehicle's safety-relevant compressed air loads.

When a so-called "fire characteristic" is detected and a predefined threshold for the detected fire characteristic is exceeded, the inventive method in particular provides for no fluid connection to an auxiliary load circuit. If there was fluid communication at the point in time of a fire characteristic being detected, such a fluid connection to an auxiliary load circuit is disconnected, preferably by a valve or other comparable mechanism. This thus always ensures that the compressed air buffer tank can be supplied with sufficient compressed air from the central compressed air source upon detection of a fire characteristic without thereby impairing the functioning of the load of the load circuit relevant to safe vehicle operation.

A further embodiment of the invention comprises a pressure limit, whereby the air pressure in the compressed air buffer tank is kept equal to and/or higher than this minimum pressure. When there is fluid communication between the central compressed air source and the compressed air buffer tank, the air pressure in the compressed air buffer tank always remains equal to and/or higher than this minimum pressure and thus ensures the operational readiness of the inventive system for preventing and/or extinguishing a fire. This also particularly applies to the case of compressed air being withdrawn from the compressed air buffer tank, e.g. to render the target area inert, or the adjoining compressed air system having one or more leakages.

The method according to the invention further provides for being able to control the feed of compressed air as needed from the compressed air buffer tank to the gas separation device by means of a control device. To control this process, the oxygen concentration in the target area is determined and compared to a preferably preset control concentration/control range. A valve is actuated as a function of this comparison in order for compressed air to be supplied to the gas separation device as needed. By means of the control device, a preferably preset control concentration and/or preset control range for the concentration of oxygen in the target area can thus always be maintained. Therefore, it is always possible to prevent fire and/or extinguish fire in the target area at all times during which the inventive method is in use.

In addition to a method, the present invention further claims a system for preventing and/or extinguishing fire in an enclosed target area in a track-guided vehicle. The vehicle further comprises a central compressed air source to that end, whereby the system according to the invention further comprises a compressed air buffer tank, a gas separation device and at least one valve. The compressed air buffer tank and the central compressed air source of the vehicle as well as the gas separation device and the target area are thereby at least intermittently connected together in fluid communication. The inventive system in particular additionally comprises a control device in a first compressed air line. The system according to the invention can thus implement the inventive method for preventing and/or extinguishing fire within an enclosed target area in a track-guided vehicle. The valve station comprises at least one valve having at least one outlet for that purpose.

In a further embodiment of the inventive system, the control device comprises at least one valve station and one control unit. Hereby to be understood by valve is preferably a check valve, a directional valve or another such comparable valve for the as-needed feeding of compressed air to at least one load and/or load circuit. Preferably, the control device further comprises a pressure gauge and/or flowmeter device, which preferably serves in measuring the main load circuit's consumption of compressed air. It is equally conceivable in line with the present invention for the pressure gauge and/or flowmeter device to be arranged within the control device so as to enable the measuring of the compressed air consumption of the auxiliary load circuit or all fluidly connected loads.

The control unit is additionally suited to controlling the valve station, preferably as a function of the pressure gauge and/or flowmeter device. As a result, the control device can control the as-needed supply of compressed air to the main load circuit, the auxiliary load circuit as well as the compressed air buffer tank via the control unit for controlling the valve station. To that end, it is possible to store the classifying of the vehicle's individual compressed air loads to the main load circuit and to the auxiliary load circuit in the control unit such that the control unit can differentiate the compressed air loads of safety-relevant priority from the loads of lesser priority. Doing so thus ensures the individual systems, particularly the main load circuit, the auxiliary load circuit and the inventive system, will always be optimally supplied.

Preferably, at least one pressure gauge and/or flowmeter device can be used in this context to measure, determine, control, compare or otherwise metrologically utilize the consumption of compressed air by the individual system components, particularly the main load circuit. This thus ensures a safe allocation of the available compressed air from the central compressed air source and being able to variably adapt, control and/or regulate same.

A further embodiment of the present invention comprises a check valve between the central compressed air source and the compressed air buffer tank. The check valve is preferably designed as a non-return valve. Doing so thus enables preventing the compressed air within the compressed air buffer tank from flowing back to the central compressed air source. The reservoir of compressed air within the compressed air buffer tank is thus available at all times for preventing and/or extinguishing fire in the target area and cannot be affected by a drop in pressure in the vehicle's compressed air system. In a dangerous situation, for example when the track-guided vehicle is non-operational and/or limited in its operation due to a leak in the central compressed air system, fire prevention and/or fire extinguishing can thus be maintained.

Furthermore, one embodiment can comprise a fire detection device, particularly an aspirative fire detection device, in the target area which is suited to detecting at least one fire characteristic in the ambient air of the target area. This thus ensures sensitive detection of a fire characteristic throughout the entire spatial volume of the target area based on the extracting of representative air samples and the triggering of a fire extinguishing procedure by the nitrogen-enriched gas mixture reducing the oxygen concentration in an emergency.

An aspirative fire detection device is characterized by representative air samples being extracted from the monitored target area continuously or at predetermined times and/or upon predetermined events, wherein these air samples are then fed to a corresponding fire characteristic detector.

In one embodiment, the inventive system can comprise at least one oxygen measuring device in the target area for determining the concentration of oxygen within the target area. The inventive system thus enables being able to make a concrete statement as to the oxygen concentration or, respectively, the potential fire risk in the target area at all times during system operation.

In a further embodiment, a control device is provided for the present invention which comprises the connections to the at least one oxygen measuring device in the target area and to the at least one valve in a second compressed air line. The control device can thus convert measurement data of the oxygen measuring device into control of the valve and control the as-needed feed of compressed air to the gas separation device by actuating the valve. The control device can directly adapt a deviation in the oxygen concentration from a control range or a control concentration respectively by means of controlling the valve. This yields the feasibility of continuous status monitoring of the target area so as to ensure reliable fire prevention and/or fire extinguishing.

One embodiment of the inventive system further preferably comprises an auxiliary compressor for supplying compressed air to the gas separation device as needed. The auxiliary compressor can in particular realize a so-called sustained flooding, wherein an inertization level subsequent the initial lowering of the oxygen concentration is maintained in the target area. Particularly when there is leakage in the target area, the nitrogen-enriched gas mixture introduced for inerting purposes can leak out of the target area. If in this case there is no sustained flooding in the form of replenishing the nitrogen-enriched gas mixture, a rising concentration of oxygen will result in the enclosed target area.

In this case, the auxiliary compressor preferably feeds compressed air as needed to the gas separation device and, as a result, the nitrogen-enriched gas mixture is introduced into the target area. It is in this way possible for an inertization level to be maintained in the target area despite it having one or more leakages without needing to supply additional compressed air from the central compressed air source to the compressed air buffer tank.

It is furthermore also conceivable in the sense of the inventive system for the auxiliary compressor to not only be able to compensate for leakages in the enclosed target area by feeding compressed air to the gas separation device as needed but also preferably be able to effect inertization in the target area, in particular an initial lowering of the oxygen concentration, without needing to draw compressed air from the compressed air buffer tank. It is therefore also unnecessary in this case to establish a fluid connection between the central compressed air source and the compressed air buffer tank. The oxygen concentration in the enclosed target area can thus be initially lowered by means of the auxiliary compressor, whereby main load circuit loads are concurrently supplied with compressed air from the central compressed air source.

In addition to a method and a system for preventing and/or extinguishing a fire, the present invention further claims a vehicle having a central compressed air source and an enclosed target area. To be understood by a vehicle in this context is in particular a track-guided vehicle. The vehicle likewise particularly comprises a system according to the invention for preventing and/extinguishing fire. Outbreak of a fire in a target area can accordingly be prevented and/or extinguished in vehicles of such design by means of the provided system, whereby optimized fire protection conditions are granted during vehicle operation.

BRIEF DESCRIPTION OF THE DRAWINGS

The following will reference the accompanying drawings in describing example embodiments of the present invention.

Shown are.

DETAILED DESCRIPTION OF AN EMBODIMENT OF THE INVENTION

Figure 1:
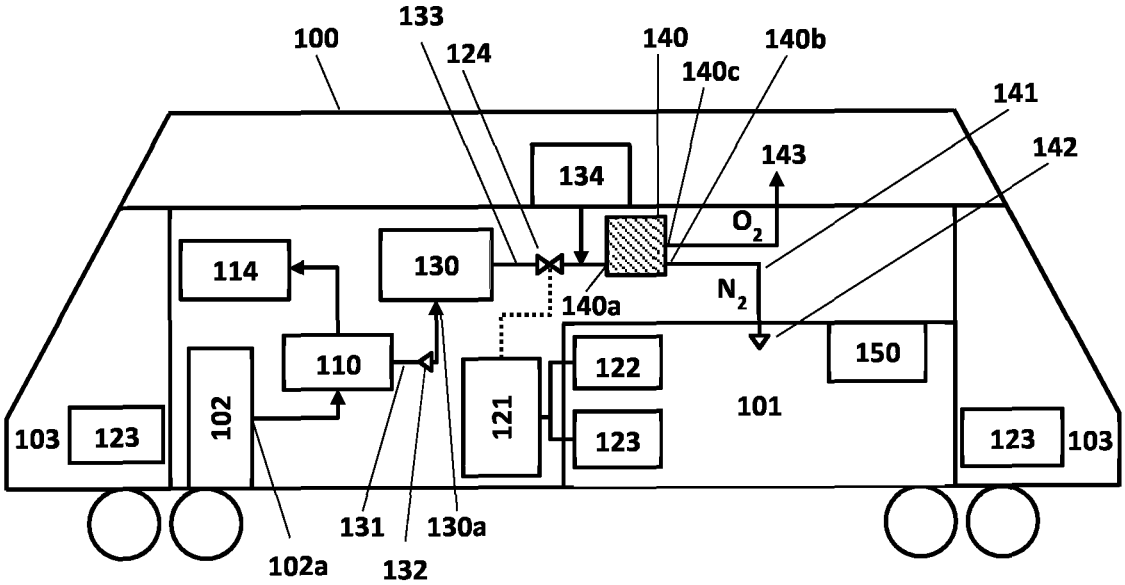
FIG. 1 a schematic view of the basic structure of an example embodiment of the inventive system for preventing and/or extinguishing fire.

FIG. 1 is a schematic representation of the basic structure of an example embodiment of the inventive vehicle 100 having a central compressed air source 102 and a target area 101 as well as the inventive system for preventing and/or extinguishing fire. Included among the essential components of the inventive system in FIG. 1 are in particular a control device 110, a compressed air buffer tank 130, a control device 121 for controlling a valve 124 and a gas separation device 140.

The following will assume that nitrogen or a nitrogen-enriched gas mixture is used as the inert gas in the example embodiments of the inventive system depicted in the drawings, whereby, however, this is not to be regarded as a limitation. Of course, other inert gases or inert gas mixtures or extinguishing gases respectively can also be used for the preventing and/or extinguishing of fire.

In the schematically depicted embodiment of the inventive system shown in FIG. 1, the outlet 102*a* of the central compressed air source 102 of the vehicle 100 is fluidly connected to the control device 110. A load circuit 114, preferably comprising a main load circuit 114*a* and an auxiliary load circuit 114*b*, is connected to the control device 110, as is the inlet 130*a* of compressed air buffer tank 130 so that compressed air from the central compressed air source 102 can be routed to these components.

It is thereby in particular provided for the central compressed air source 102 to supply the compressed air buffer tank 130 with compressed air when no compressed air is being drawn from the central compressed air source 102 or when compressed air is being drawn from the central compressed air source 102 for only at least one load of the auxiliary load circuit 114*b*. To be understood in this context by the withdrawal of compressed air for a load is compressed air being supplied to a load, or the load drawing compressed air from a reservoir respectively, so that it can perform its intended function. Whenever a load of the main load circuit 114*a* draws, respectively uses, compressed air from the central compressed air source 102, the control device 110 disconnects or blocks the fluid connection between the central compressed air source 102 and the compressed air buffer tank 130 so that no further compressed air can be conducted to the compressed air buffer tank. Thus, according to the inventive method, the compressed air buffer tank can be intermittently supplied with compressed air from the central compressed air source 102 without thereby limiting vehicle safety functions during the operation of the vehicle 100.

A check valve 132, for example in the form of a non-return valve, is provided between the control device 110 and the compressed air buffer tank 130 in a first compressed air line 131 for preventing a return flow of compressed air from the compressed air buffer tank 130. Accordingly, a volume of compressed air within the compressed air buffer tank 130 is preferably unable to flow back into the vehicle's compressed air system and is thus exclusively reserved for fire prevention and/or fire extinguishing in the enclosed target area.

After the initial lowering of the oxygen concentration in the enclosed target area 101, leakages in the enclosed target area 130 can result in nitrogen-enriched gas mixture subsequently escaping from the target area, thus yielding an associated unwanted increase in the oxygen concentration. In order to prevent such an inerting level deficiency subsequent the initial lowering of the oxygen concentration in the target area 130, replenishing of a nitrogen-enriched gas mixture may be necessary as required. On the basis of such sustained flooding, an inertization level can also be maintained in an enclosed target area 101 having one or more leakages.

An auxiliary compressor 134 is preferably used for the sustained flooding in the sense of the present invention. This auxiliary compressor 134 is designed to supply compressed air as needed to the gas separation device 140 and, in so doing, maintain an inertization level in the enclosed target area 101. In the same way, the present invention does not exclude also using the auxiliary compressor 134 to initially lower the oxygen concentration in the target area 101, particularly when the main load circuit 114*a* is drawing compressed air from the central compressed air source 102. To that end, the auxiliary compressor can feed compressed air as needed to the gas separation device 140 with the aid of a control device 121, by using a comparable independent control means and/or manually from the driver's compartment, preferably by the vehicle driver.

A second compressed air line 133 fluidly connects the compressed air buffer tank 130 to the inlet 140*a* of the gas separation device 140. A valve 124 able to be controlled by control device 121 is further provided in said second compressed air line 133. The controlling of the valve 124 is thereby effected as a function of the oxygen concentration determined in the target area 101 by the oxygen measuring device 122. An additional display means 123 adjacent the target area 101 and/or in the vehicle driver's compartment 103 can provide the user, preferably the vehicle driver, with information such as e.g. the concentration of oxygen in the target area 101.

When the control device 121 actuates the valve 124 for the as-needed supply of compressed air from the compressed air buffer tank 130 to the gas separation device 140, compressed air flows via the second compressed air line 133 to the inlet 140*a* of gas separation device 140. Subsequent to the effected gas separation, oxygen ($O_2$) as well as further components if applicable can be discharged into the environment from the second outlet 140*c* of the gas separation device via $O_2$ discharge 143. The gas mixture enriched with nitrogen ($N_2$) is conducted to the target area 101 via the first outlet 140*b* of the gas separation device 140 by fluid connection 141 and introduced into the target area 101 through a nozzle 142. The oxygen concentration in the target area 101 is in this manner lowered as needed.

A fire detection device 150 can furthermore be provided in the target area 101 in accordance with FIG. 1, same preferably being realized as an aspirative fire detection device. Regardless of the exact location of a potential fire, at least one fire characteristic can thus be sensitively detected throughout the entire volume of the target area 101 by the extraction and analysis of representative air samples.

Figure 2:
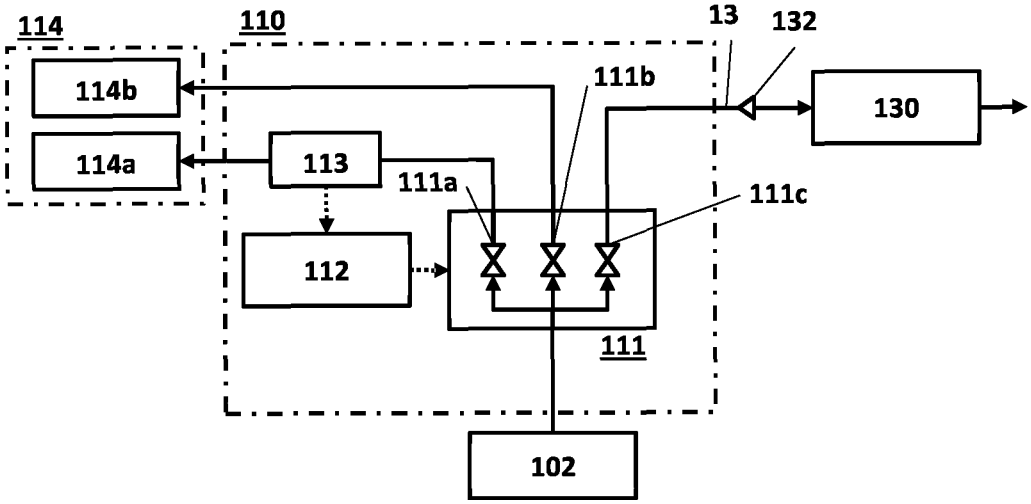
FIG. 2 a schematic view of the control device employed in the system according to FIG. 1 having fluid connections to the main load circuit, the auxiliary load circuit and the compressed air buffer tank.

FIG. 2 further shows a schematic representation of the structure of the control device 110 preferably having at least one pressure gauge and/or flowmeter device 113, one valve station 111 and a control unit 112. A data connection between the pressure gauge and/or flowmeter device 113 and the control unit 112 permits the valve station 111 to be controlled on the basis of the measurement data obtained. A control device 110 can also be used without a pressure gauge and/or flowmeter device 113. The control unit 112 can thus control the valve station 111 without utilizing measurement data from a pressure gauge and/or flowmeter device 113, e.g. on the basis of stored compressed air consumption volumes for various loads. It is moreover provided for the inventive system to be able to be manually controlled, preferably by the vehicle driver or other person authorized thereto, using suitable input means.

In accordance with FIG. 2, compressed air is fed to the valve station 111 from the central compressed air source by means of a fluid connection. As a function of the control command from control unit 112, compressed air can be relayed as needed from there to the compressed air buffer tank 130. In accordance with the depicted example embodiment, the valve station 111 comprises three valves thereto, each having a respective outlet 111*a;* 111*b*; 111*c*. Fluid connections run from two of these outlets 111*a;* 111*b* to the loads of the main load circuit 114*a* and the auxiliary load circuit 114*b*. Depending on the valve position of valve station 111, it is correspondingly possible to exclusively supply the load of the main load circuit 114*a* in order to ensure the safety-relevant functions of the vehicle 100. Alternatively, compressed air can be fed from the central compressed air source 102 to the loads of the auxiliary load circuit 114*b* and the compressed air buffer tank 130.

The invention is not limited to these example embodiments depicted schematically in the drawings but rather yields from an integrated consideration of all the features disclosed herein in context.

LIST OF REFERENCE NUMERALS

100 track-guided vehicle
101 target area
102 central compressed air source

102*a* central compressed air source outlet
103 vehicle driver compartment
110 control device
111 valve station
111*a* first outlet
111*b* second outlet
111*c* third outlet
112 control unit
113 pressure gauge and/or flowmeter device
114 load circuit
114*a* main load circuit
114*b* auxiliary load circuit
121 control device
122 oxygen measuring device
123 display means
124 valve
130 compressed air buffer tank
130*a* compressed air buffer tank inlet
131 first compressed air line
132 non-return valve
133 second compressed air line
134 auxiliary compressor
140 gas separation device
140*a* gas separation device inlet
140*b* first outlet of gas separation device
140*c* second outlet of gas separation device
141 fluid connection with target area
142 nozzle
143 $O_2$ discharge
150 fire detection device

The invention claimed is:

1. A method for preventing and/or extinguishing a fire in an enclosed target area in a vehicle, wherein the vehicle comprises a central compressed air source for supplying compressed air to a load circuit, and wherein the method comprises steps of:

providing a compressed air buffer tank in the vehicle for buffering the compressed air supplied by the central compressed air source;

providing a supply of the compressed air from the central compressed air source of the vehicle in the compressed air buffer tank of the vehicle;

supplying the compressed air from the compressed air buffer tank to a gas separation device as needed;

temporarily storing the compressed air provided by the central compressed air source in the compressed air buffer tank;

performing a gas separation in the gas separation device and providing a nitrogen-enriched gas mixture at an outlet of the gas separation device; and introducing the nitrogen-enriched gas mixture into the enclosed target area as needed, wherein in order to provide the supply of compressed air, an inlet of the compressed air buffer tank is at least intermittently fluidly connected to an outlet of the central compressed air source wherein the compressed air can be supplied to the compressed air buffer tank, and wherein a fluid connection between the central compressed air source and the compressed air buffer tank is provided when the load circuit is not drawing any of the compressed air from the central compressed air source.

2. The method according to claim 1, wherein an initial lowering of an oxygen concentration in the enclosed target area begins upon and/or subsequent an activation of the vehicle, terminates prior to and/or subsequent a start of travel, and further comprises steps of:

determining the oxygen concentration in the enclosed target area;

comparing the oxygen concentration determined in the enclosed target area to a preset control concentration/control range;

supplying the compressed air from the compressed air buffer tank to the gas separation device as needed;

providing the nitrogen-enriched gas mixture at the outlet of the gas separation device; and introducing the nitrogen-enriched gas mixture into the enclosed target area as needed until the preset control concentration/control range is reached in the enclosed target area.

3. The method according to claim 2, wherein at least one fire characteristic can be detected in the enclosed target area by a fire detection device, and the oxygen concentration in ambient air of the enclosed target area can be reduced from a full inerting level upon the at least one fire characteristic being detected if the at least one fire characteristic detected exceeds a predefined threshold, wherein the full inerting level corresponds to a preset oxygen concentration and/or an oxygen concentration range.

4. The method according to claim 3, wherein the fire detection device is an aspirative fire detection device.

5. The method according to claim 1, wherein the load circuit is a main load circuit with an ancillary load circuit being further provided, wherein the fluid connection is also provided between the central compressed air source and the compressed air buffer tank when the ancillary load circuit draws the compressed air from the central compressed air source.

6. The method according to claim 5, wherein upon a fire characteristic being detected, there is no fluid connection provided to the ancillary load circuit, or an existing fluid connection to the ancillary load circuit is disconnected, if the detected fire characteristic exceeds a predefined threshold.

7. The method according to claim 1, wherein a pressure in the compressed air buffer tank is kept at and/or above a minimum pressure.

* * * * *